United States Patent [19]

Ahlgren

[11] 4,129,631

[45] Dec. 12, 1978

[54] METHODS FOR GUIDING SLIP-FORMS IN SLIP-FORM CONCRETING

[76] Inventor: Nils H. Ahlgren, Skyttevägen 22, Saltsjöbaden, Sweden, S-133 00

[21] Appl. No.: 746,095

[22] Filed: Nov. 30, 1976

[30] Foreign Application Priority Data

Dec. 23, 1975 [SE] Sweden ..... 7514590

[51] Int. Cl.[2] ..... E04B 1/16

[52] U.S. Cl. ..... 264/33; 249/20; 264/34; 425/63

[58] Field of Search ..... 264/33, 34; 425/63–65; 249/20–22

[56] References Cited

U.S. PATENT DOCUMENTS 2,617,168 11/1952 Johnson ..... 264/33

*Primary Examiner*—Thomas P. Pavelko

*Attorney, Agent, or Firm*—Rose & Edell

[57] ABSTRACT

A method for guiding slip-forms in the casting of concrete structures where use is made of a rigid slip-form which is repeatedly lifted first at that side of the concrete structure being cast from which the slip-form is to be guided away, such that the slip-form when being lifted is shifted towards the opposite side where, in subsequent operations, it is repeatedly lifted to the same level as it was previously caused to occupy at the side from which the slip-form is to be guided away.

8 Claims, 6 Drawing Figures

METHODS FOR GUIDING SLIP-FORMS IN SLIP-FORM CONCRETING

FIELD OF THE INVENTION

The present invention relates to a method for guiding slip-forms in the casting of concrete structures.

BACKGROUND OF THE INVENTION

According to the invention, the slip-form concreting is carried out by means of a rigid slip-form, which is repeatedly lifted first at that side of the concrete structure being cast from which the slip-form is to be guided away, such that the slip-form when being lifted is shifted towards the opposite side, where, in subsequent operations, it is repeatedly lifted to the same level as it was previously caused to occupy at the side from which the slip-form is to be guided away. Since it is possible to carry out the method according to the invention by using a conventional slip-form jacking equipment, this method can be readily applied where a rigid slip-form is utilized By this invention it has thus become possible to provide a guiding method which on account of its simplicity is quite outstanding as compared with the prior art methods of this kind.

BRIEF DESCRIPTION OF THE DRAWINGS

The invention will be described below in greater detail with reference to the accompanying drawings in which.

DESCRIPTION OF THE PREFERRED EMBODIMENTS

Figure 1:
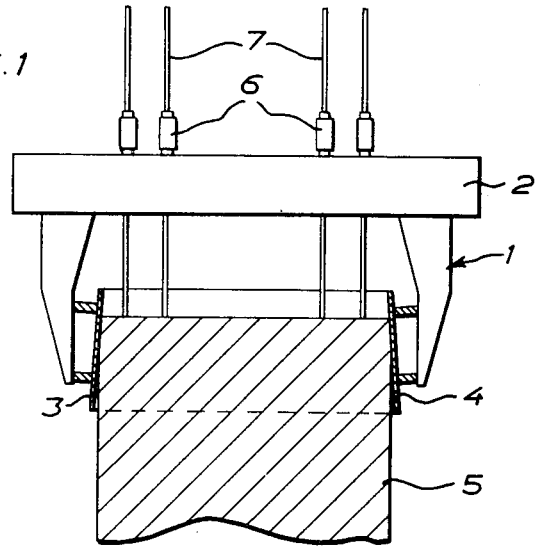
FIGS. 1 to 5 illustrate the method according to the invention where use is made of a single slip-form.

Referring to the drawings, the rigid slip-form is designated 1 in FIGS. 1 to 4. The fact that the slip-form 1 is at least substantially rigid is illustrated by the robust girder arrangement 2 interconnecting the two sides 3 and 4 of the slip-form 1. The concrete structure being cast is designated 5.

The rigid slip-form 1 is adapted to be lifted by a number of hydraulic jacks 6 which are uniformly distributed along the concrete structure and incorporated in a common hydraulic system, such that all the jacks will exert an equally great lifting power. Since there is normally obtained a uniform lift at all points simultaneously, the prevailing load conditions will determine where the load of the jacks 6 is smallest, and, consequently, where the lifting will first occur. To effect the lifting operation, the jacks 6 cooperate with jack-rods 7 being for instance vertical reinforcement rods.

In case it is desirable to guide the slip-form 1 towards the side where the slip-form is designated 3, the slip-form 1 should be repeatedly lifted first at the side where the slip-form is designated 4. As is easily understood, the slip-form 1 will thereby be shifted towards the side 3 where, in subsequent operations, it is repeatedly lifted to the same level that the slip-form previously occupied at the side 4. This will appear from a comparative study of FIGS. 1 to 4.

Figure 2:
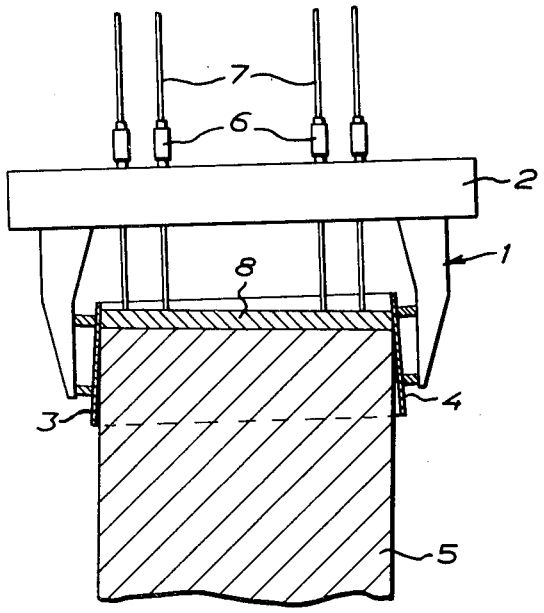
Figure 3:
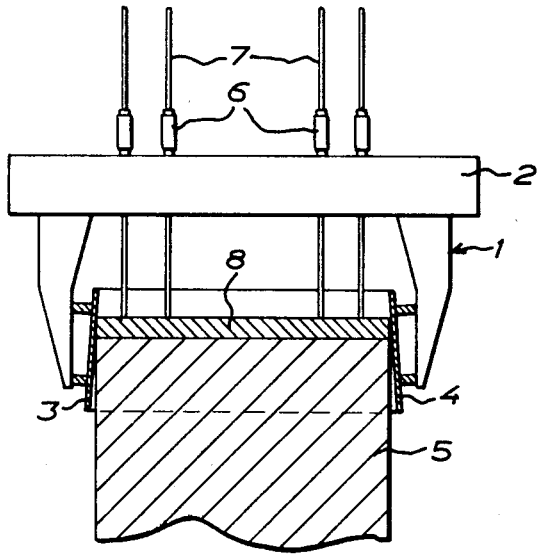
Figure 4:
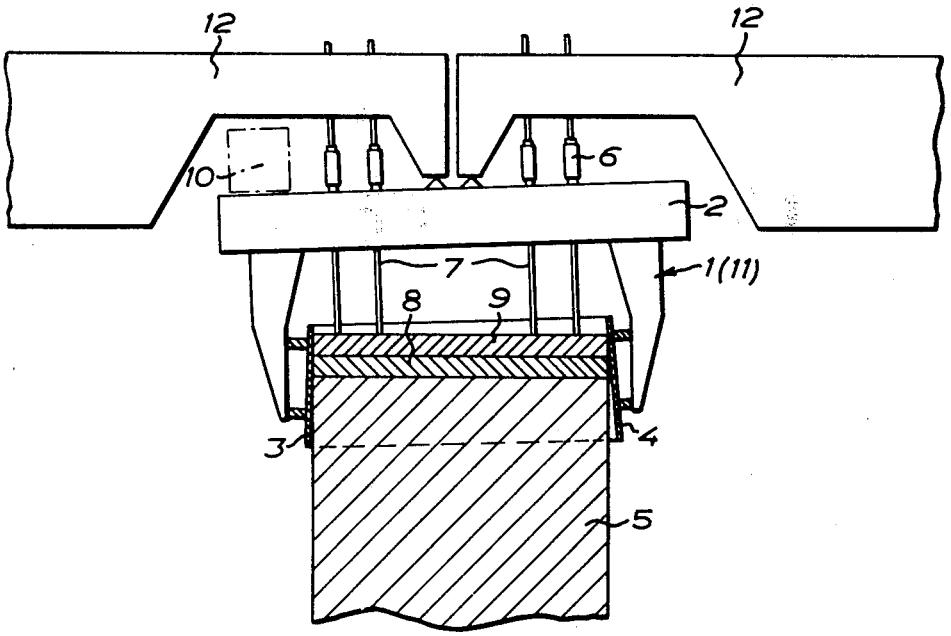

In FIG. 1, the rigid slip-form 1 is in horizontal position. In FIG. 2, the slip-form 1 has been lifted at the side 4 from which it is to be guided away during casting. The concrete layer being placed at this stage or at a later stage to the concrete structure 5 is designated 8. In FIG. 3, the slip-form has been lifted at the side 3 to the same level that it previously occupied at the side 4, that is to say the slip-form 1 is again in horizontal position. As shown in FIG. 4, the slip-form 1 has again been lifted at the side 4, and an additional concrete layer 9 has been placed on the concrete structure 5. Normally, several lifting operations are effected between two applications of additional concrete layers. The side 3 is thereafter raised to the same level as the side 4. This alternating lifting at the sides 3 and 4 is repeated until the desired guiding effect is obtained. The guiding operation may aim at providing an inclined concrete structure 5 or be effected to compensate for wind load.

As shown in FIGS. 1 to 3, use is made of a greater number of jacks 6 at the side where the lifting is first to take place than at the opposite side. In the event the side 4 is to be lifted first, either an additional jack 6 is engaged at the side 4 or a jack 6 is disengaged at the side 3. If the side 3 is to be raised first, the inverse mode of action is adopted. Here, it is presupposed that the jacks 6 have the same piston area, since it is the increase and the decrease of the effective piston area on both sides that is decisive.

Instead of changing the effective piston area on either side, it is possible to apply a greater load at the side 3 of the rigid slip-form 1 where the lifting is to be performed subsequently, than at the opposite side 4. This is shown in FIG. 4, in which the broken lines indicate a weight 10.

Figure 5:
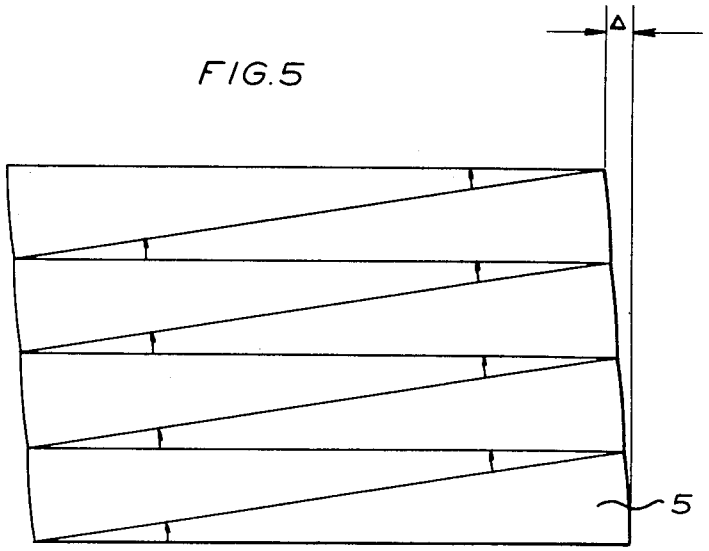

It is apparent from FIG. 5, how the lateral shift $\Delta$ has been obtained by four repeated lifting operations according to the invention, that is the slip-form 1 has been repeatedly lifted first at the side thereof where the shift $\Delta$ is obtained. In actual practice, the slip-form 1 is raised about 2.5 cm at a time, FIG. 5 illustrating the shift on an exaggerated scale.

Figure 6:
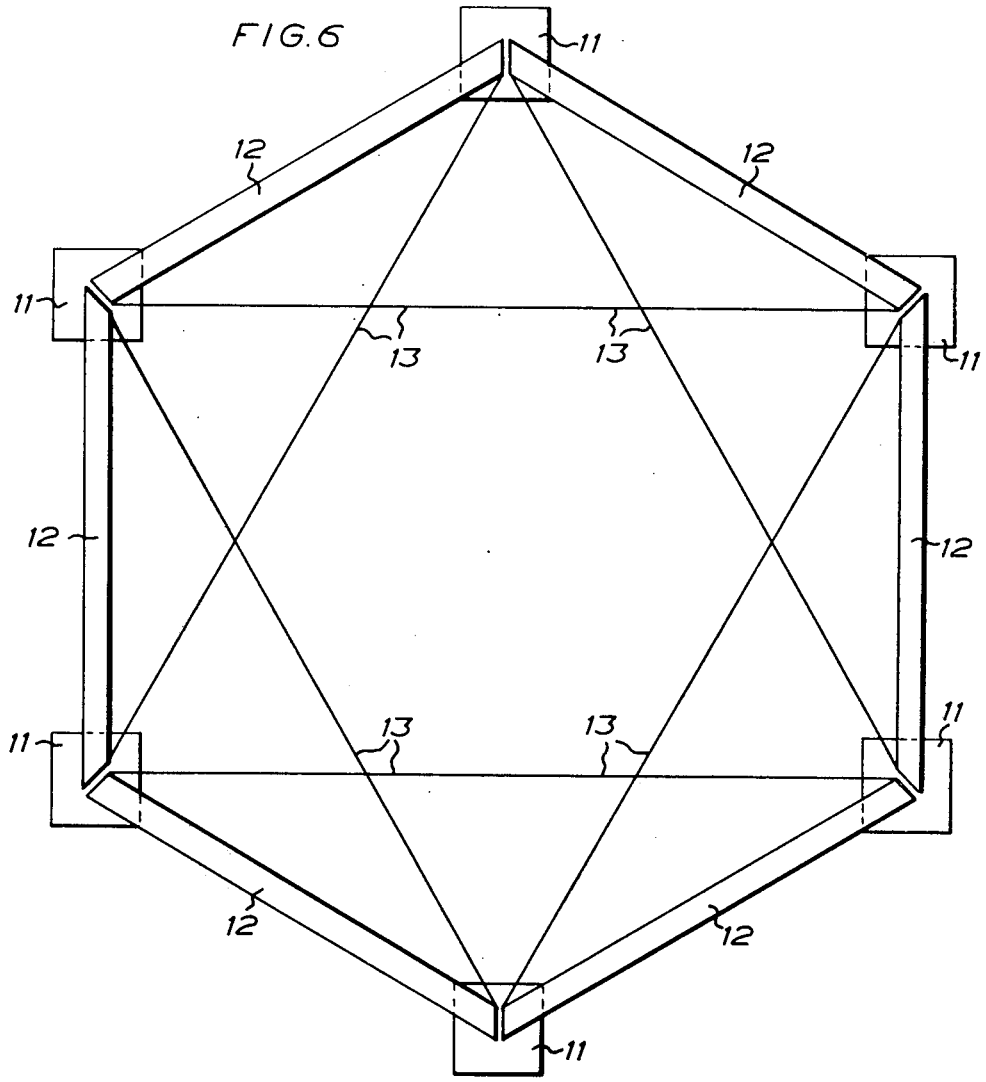
FIG. 6 shows the provision of a plurality of rigid slip-forms for carrying out the method of the invention.

According to FIG. 6, the slip-form concreting is effected by using several rigid slip-forms which are movably connected with each other by spacers 12, such that the rigid slip-forms 11 can be guided independently of each other in agreement with the method of the invention. Between the concrete structures which are cast by means of the rigid slip-forms 11, it is also possible, by means of slip-forms, to cast concrete structures, preferably of relatively slender dimensions. The slip-forms employed for this purpose are movably connected with the rigid guidable slip-forms 11.

The spacers 12 preferably consist of such constructional units as engage at or adjacent the centre of the lift force resultant at the rigid slip-forms illustrated in FIG. 4. The rigid slip-forms 11 are connected with each other not only by means of the spacers 12 but also by stays 13 fixing the relative positions of the rigid slip-forms 11. The stays 13, together with the spacers 12, form triangular units.

The stays 13 are not necessarily connected directly to the spacers 12 but may be connected thereto via suitable adjustment means. In a preferred embodiment, the adjustment means are hydraulic, whereby overloading of the stays can be readily avoided.

The present invention is not restricted to what has been described above and shown in the drawings, but may be modified in various ways within the spirit and scope of the appended claims.

The embodiments of the invention in which an exclusive property or privilege is claimed are defined as follows:

1. A method for guiding rigid slip-forms in the casting of concrete structures, where the rigid slip-form is guided away from one side of the structure being cast; said method comprising in any one lifting sequence of operations, said rigid slip-form being first lifted at a first side of the concrete structure being cast to a new higher position, from which side the slip-form is to be guided away, such that the slip-form when being lifted is shifted towards a second, opposite side; and being then lifted at said second side to said new higher position so that said rigid slip-form is guided away from said first side.

2. A method as claimed in claim 1, wherein said lifting sequence of operations is effected by lifting jacks, and the number of jacks utilized at said first side where the lifting sequence of operations is to be effected first, is greater than the number of jacks utilized at said second, opposite side.

3. A method as claimed in claim 1, wherein said lifting sequence of operations is effected by lifting jacks, and a greater load is applied to said rigid slip-form at said second side at which said lifting sequence of operations is subsequently to be effected.

4. A method as claimed in claim 1, wherein said slip-form concreting is effected by using a number of rigid slip-forms which are movably interconnected by spacers, said rigid slip-forms being guided independently of each other.

5. A method as claimed in claim 4, wherein said spacers consist of constructional units which engage said slip-forms at or adjacent the centre of the lift force resultant at each respective rigid slip-form.

6. A method as claimed in claim 4 wherein there is a relative tiltability between any one end of any one of said spacers and the respective rigid slip-form to which it is connected.

7. A method as claimed in claim 4, wherein said rigid slip-forms are movably inter-connected to said spacers and also are connected to stays which fix the positions of said slip-forms relative to one another.

8. A method as claimed in claim 7, wherein said stays are connected to said spacers by and cooperate with hydraulic adjustment means.

* * * * *